US012276272B2

(12) United States Patent
Maruyama et al.

(10) Patent No.: US 12,276,272 B2
(45) Date of Patent: Apr. 15, 2025

(54) DIAPHRAGM PUMP

(71) Applicant: MARUYAMA MFG. CO., INC., Tokyo (JP)

(72) Inventors: Yushi Maruyama, Tokyo (JP); Toshihisa Nemoto, Tokyo (JP)

( * ) Notice: Subject to any disclaimer, the term of this patent is extended or adjusted under 35 U.S.C. 154(b) by 93 days.

(21) Appl. No.: 18/325,114

(22) Filed: May 30, 2023

(65) Prior Publication Data

US 2023/0392590 A1 Dec. 7, 2023

(30) Foreign Application Priority Data

Jun. 2, 2022 (JP) ..... 2022-090307

(51) Int. Cl.
*F04B 43/06* (2006.01)

(52) U.S. Cl.
CPC ..... *F04B 43/06* (2013.01)

(58) Field of Classification Search
CPC ..... F04B 43/06; F04B 43/0054
See application file for complete search history.

(56) References Cited

U.S. PATENT DOCUMENTS 5,279,504 A * 1/1994 Williams ..... F04B 43/06 417/393

FOREIGN PATENT DOCUMENTS

| | | | |
|---|---|---|---|
| EP | 1505291 | 2/2005 | |
| EP | 1914416 | 4/2008 | |
| EP | 1914416 A1 * | 4/2008 | ..... F01M 13/022 |
| JP | S49-019118 | 2/1974 | |
| JP | 2010-090846 | 4/2010 | |

OTHER PUBLICATIONS

Extended Search Report in corresponding European Application No. 23175261.9 dated Oct. 25, 2023.

* cited by examiner

*Primary Examiner* — Kenneth J Hansen
(74) *Attorney, Agent, or Firm* — SOEI PATENT & LAW FIRM

(57) ABSTRACT

A diaphragm pump includes a low pressure side diaphragm forming a part of a pulsation operating chamber, a high pressure side diaphragm forming a part of a pump chamber, and a connecting portion connecting the low pressure side diaphragm and the high pressure side diaphragm. The high pressure side diaphragm operates in conjunction with the low pressure side diaphragm by being connected to the low pressure side diaphragm by the connecting portion. An area of a high pressure side operating portion of the high pressure side diaphragm is smaller than an area of a low pressure side operating portion of the low pressure side diaphragm.

20 Claims, 4 Drawing Sheets

DIAPHRAGM PUMP

CROSS-REFERENCE TO RELATED APPLICATIONS

The disclosure is based upon and claims the benefit of priority from Japanese Patent Application No. 2022-090307, filed on Jun. 2, 2022, the entire contents of which are incorporated herein by reference.

BACKGROUND

Field

The present disclosure relates to a diaphragm pump that operates by receiving a pulsating pressure in a crank chamber of an engine.

Description of the Related Art

Japanese Patent Publication No. 2010-90846 discloses an engine having a diaphragm pump. The diaphragm pump operates by receiving a pulsating pressure in a crank chamber of an engine.

SUMMARY

Disclosed herein is an example diaphragm pump that operates by receiving a pulsating pressure in a crank chamber of an engine, the diaphragm pump including: a low pressure side diaphragm forming a part of a pulsation operating chamber to which the pulsating pressure is transmitted and configured to operate by receiving the pulsating pressure; a high pressure side diaphragm forming a part of a pump chamber for supplying fuel to the engine and configured to send the fuel to the engine by operating; and a connecting portion connecting the low pressure side diaphragm and the high pressure side diaphragm to each other. The high pressure side diaphragm operates in conjunction with the low pressure side diaphragm by being connected to the low pressure side diaphragm by the connecting portion. An area of a high pressure side operating portion that is a portion of the high pressure side diaphragm which operates in conjunction with the low pressure side diaphragm is smaller than an area of a low pressure side operating portion that is a portion of the low pressure side diaphragm which operates by receiving the pulsating pressure.

In this diaphragm pump, the diaphragm (the low pressure side diaphragm) that operates by receiving the pulsating pressure in the crank chamber and the diaphragm (the high pressure side diaphragm) that sends the fuel are separately provided. The high pressure side diaphragm operates in conjunction with the low pressure side diaphragm, and the area of the high pressure side operating portion is smaller than the area of the low pressure side operating portion. In some examples, due to the difference in area between the low pressure side operating portion and the high pressure side operating portion, the high pressure side diaphragm (20) may apply a pressure higher than the pulsating pressure in the crank chamber to the fuel. The diaphragm pump may further pressurize the fuel by receiving the pulsating pressure in the crank chamber of the engine and supply the further pressurized fuel.

In some examples, the diaphragm pump has a low pressure side backup attached to the low pressure side operating portion and a high pressure side backup attached to the high pressure side operating portion. An area of the low pressure side backup is larger than an area of the high pressure side backup. Accordingly, the diaphragm pump may curb unintended deflection of the low pressure side diaphragm and the high pressure side diaphragm with the low pressure side backup and the high pressure side backup and to operate the low pressure side diaphragm and the high pressure side diaphragm.

In some examples, the low pressure side diaphragm has an annular low pressure side movable portion around the low pressure side backup. The high pressure side diaphragm has an annular high pressure side movable portion around the high pressure side backup. A width of the annular low pressure side movable portion in a radial direction is smaller than a width of the annular high pressure side movable portion in a radial direction. By reducing the width of the low pressure side movable portion, the diaphragm pump may curb the low pressure side movable portion being movable. The entire low pressure side diaphragm moves, and the high pressure side diaphragm may be operated in conjunction with the low pressure side diaphragm. Further, since the width of the high pressure side movable portion is larger than the width of the low pressure side movable portion, a stroke (a movement amount) of the high pressure side diaphragm can be ensured to be larger. Accordingly, when the high pressure side diaphragm operates in conjunction with the low pressure side diaphragm (10), the high pressure side diaphragm may be operated without being restricted in the amount of movement caused by the width of the high pressure side movable portion.

Additionally, an example diaphragm pump is disclosed herein. A diaphragm pump that operates by receiving a pulsating pressure in a crank chamber of an engine. The diaphragm pump includes a low pressure side diaphragm forming a part of a pulsation operating chamber and configured to receive the pulsating pressure, a high pressure side diaphragm forming a part of a pump chamber and configured to send fuel to the engine, and a connecting portion connecting the low pressure side diaphragm and the high pressure side diaphragm to each other. The high pressure side diaphragm operates in conjunction with the low pressure side diaphragm by being connected to the low pressure side diaphragm by the connecting portion. An area of a high pressure side operating portion of the high pressure side diaphragm which operates in conjunction with the low pressure side diaphragm is smaller than an area of a low pressure side operating portion of the low pressure side diaphragm which operates by receiving the pulsating pressure.

Additionally, an example diaphragm pump is disclosed herein. The diaphragm pump includes a first operating chamber, and a second operating chamber, a first diaphragm located in the first operating chamber and a second diaphragm located in the second operating chamber and a connecting portion connecting the first diaphragm and the second diaphragm, and configured to operate the second diaphragm to send the fuel to the engine in response to the first diaphragm receiving the pulsating pressure. The first diaphragm includes a first surface area that is configured to receive a pulsating pressure. The second diaphragm includes a second surface area in contact with fuel for an engine. The second surface area is smaller than the first surface area.

Additionally, an example diaphragm pump disclosed herein. The diaphragm pump A diaphragm pump includes a first operating chamber, a second operating chamber located adjacent to the first operating chamber, a first diaphragm located in the first operating chamber, a second diaphragm located in the second operating chamber, and a connecting portion connecting the first diaphragm and the second diaphragm, and configured to operate the second diaphragm in response to the first diaphragm receiving the pulsating pressure. The first diaphragm includes a first surface area facing away from the second operating chamber. The second diaphragm includes a second surface area facing away from the first operating chamber. The second surface area is smaller than the first surface area.

DETAILED DESCRIPTION

In the following description, with reference to the drawings, the same reference numbers are assigned to the same components or to similar components having the same function, and overlapping description is omitted.

Figure 1:
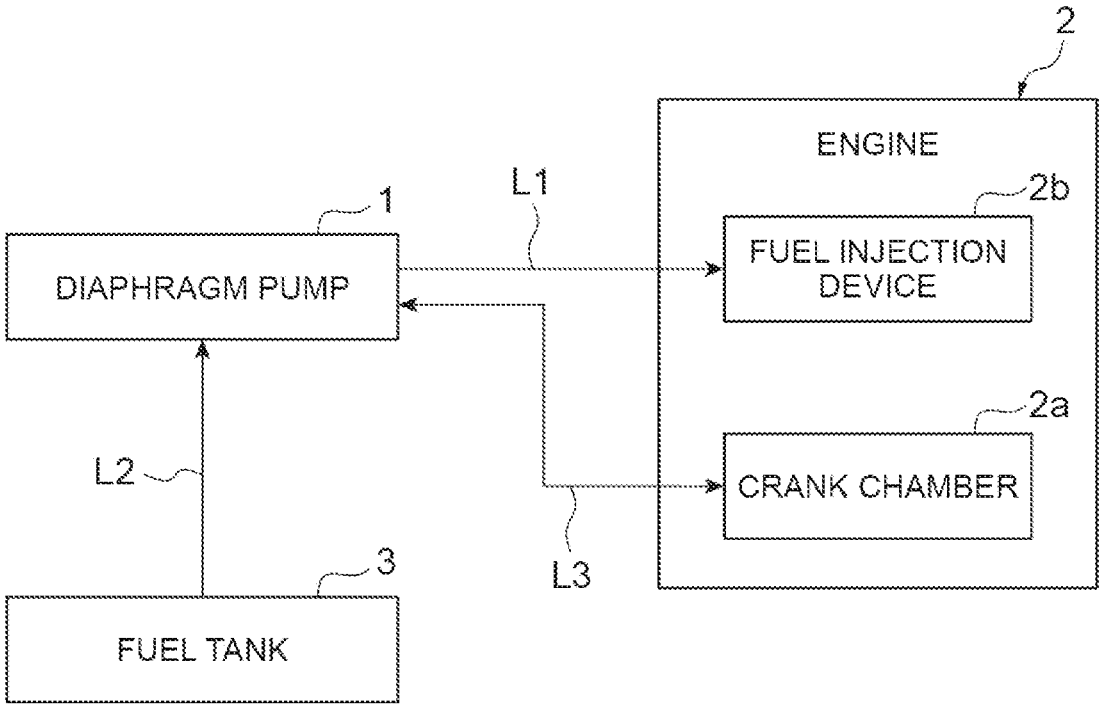
FIG. 1 is a block diagram illustrating an engine unit provided with an example diaphragm pump.

As shown in FIG. 1, an example diaphragm pump 1 functions as a fuel pump that supplies fuel to an engine 2. The diaphragm pump 1 operates by receiving a pulsating pressure of gas in a crank chamber 2*a* of the engine 2 (pressure fluctuation of gas in the crank chamber 2*a*). Here, the diaphragm pump 1 is connected to the crank chamber 2*a* of the engine 2 with a pipe L3. As a result, the diaphragm pump 1 can receive the pulsating pressure of the crank chamber 2*a* via the pipe L3.

The diaphragm pump 1 sucks the fuel from the fuel tank 3 via a pipe L2 and supplies the fuel with an increased pressure to a fuel injection device 2*b* provided in the engine 2 via a pipe L1. Further, the diaphragm pump 1 may have a mechanism for returning surplus fuel not supplied to the engine 2 of the fuel sucked from the fuel tank 3 to the tank. The fuel is an example of liquid.

Figure 2:
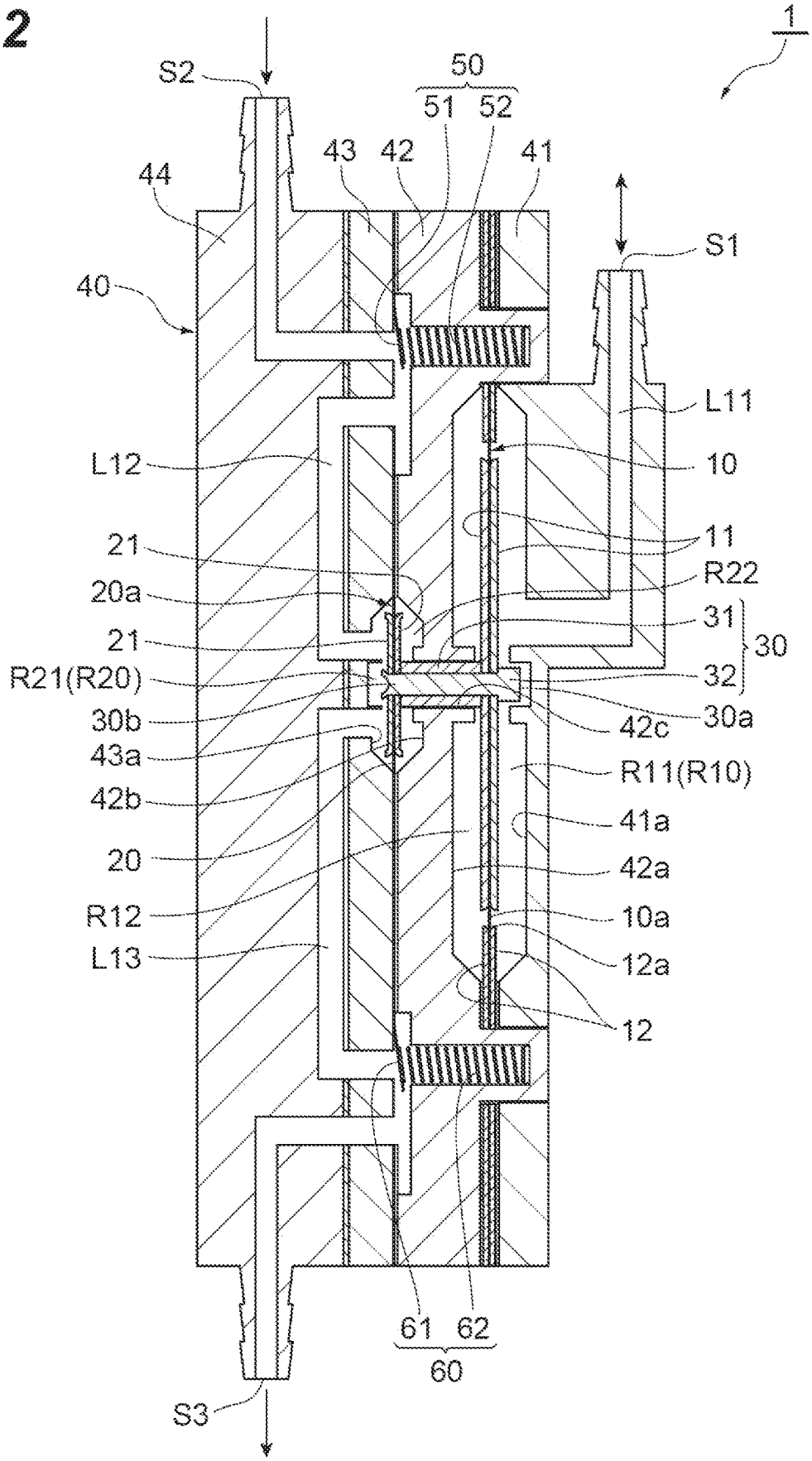
FIG. 2 is a cross-sectional view of the diaphragm pump.

The diaphragm pump 1 includes a low pressure side diaphragm 10, a high pressure side diaphragm 20, a connecting portion 30, a main body portion 40, an intake valve 50, and a discharge valve 60, as shown in FIG. 2.

The main body portion 40 has therein a first operating region R10, a second operating region R20, and the like, which will be described later. The first operating region R10 is an example of a first operating chamber. The second operating region R20 is a second operating chamber. A volume of the operating region R20 is smaller than a volume of the first operating region R10.

In some examples, the main body portion 40 is formed by stacking a first main body portion 41, a second main body portion 42, a third main body portion 43, and a fourth main body portion 44 in that order. A gasket is disposed between the stacked members of the first main body portion 41 to the fourth main body portion 44. The first main body portion 41 to the fourth main body portion 44 are fixed to each other by a screw or the like.

The first operating region R10 is formed between the first main body portion 41 and the second main body portion 42. The first operating region R10 is a region in which the low pressure side diaphragm 10 operates. The general shape of the first operating region R10 is a thin columnar shape whose axis is a stacking direction of the first main body portion 41 and the second main body portion 42.

Here, a recess 41*a* is provided in a surface of the first main body portion 41 on a side of the second main body portion 42. Further, a recess 42*a* is provided in a surface of the second main body portion 42 on a side of the first main body portion 41. The recess 41*a* and the recess 42*a* face each other. The first operating region R10 is formed by the recess 41*a* of the first main body portion 41 and the recess 42*a* of the second main body portion 42.

A pulsation transmitting port S1 is formed in the first main body portion 41. The pipe L3 (see FIG. 1) leading to the crank chamber 2*a* of the engine 2 is connected to the pulsation transmitting port S1. Further, a pulsation transmitting channel L11 that connects the pulsation transmitting port S1 and the first operating region R10 to each other is formed in the first main body portion 41.

The second operating region R20 is formed between the second main body portion 42 and the third main body portion 43. The second operating region R20 is a region in which the high pressure side diaphragm 20 operates. The general shape of the second operating region R20 is a thin columnar shape whose axis is a stacking direction of the second main body portion 42 and the third main body portion 43.

Here, a recess 42*b* is provided in a surface of the second main body portion 42 on a side of the third main body portion 43. A recess 43*a* is provided in a surface of the third main body portion 43 on a side of the second main body portion 42. The recess 42*b* and the recess 43*a* face each other. The second operating region R20 is formed by the recess 42*b* of the second main body portion 42 and the recess 43*a* of the third main body portion 43.

An intake port S2 and a discharge port S3 are formed in the fourth main body portion 44. The pipe L2 (see FIG. 1) leading to the fuel tank 3 is connected to the intake port S2. The pipe L1 leading to the fuel injection device 2*b* of the engine 2 is connected to the discharge port S3.

A low pressure side diaphragm 10 is disposed between the first main body portion 41 and the second main body portion 42. The low pressure side diaphragm 10 is an example of a first diaphragm. The low pressure side diaphragm 10 is located in the first operating region R10. In some examples, the low pressure side diaphragm 10 partitions the first operating region R10 into two. One of the spaces defined by the low pressure side diaphragm 10 is a pulsation operating chamber R11 and the other is a first back chamber R12. The pulsation operating chamber R11 is the space between the low pressure side diaphragm 10 and the recess 41*a* of the first main body portion 41 in the first operating region R10. The pulsation transmitting channel L11 is connected to the pulsation operating chamber R11 and transmits the pulsating pressure to the low pressure side diaphragm 10.

The pulsation operating chamber R11 receives the pulsating pressure. The pulsation operating chamber R11 communicates with the crank chamber 2*a* via the pulsation transmitting channel L11 and the pipe L3. The pulsating pressure of the crank chamber 2*a* is transmitted to the pulsation operating chamber R11 via the pulsation transmitting channel L11 and the pipe L3.

For example, two plates 12 are disposed between the first main body portion 41 and the second main body portion 42. The low pressure side diaphragm 10 is disposed between the two plates 12. Further, the plate 12 is provided with an opening portion 12*a* in a portion located within the first operating region R10. The opening portion 12*a* has a circular shape. In some examples, a portion of the low pressure side diaphragm 10 in the opening portion 12*a* of the plate 12 is an operating range of the low pressure side diaphragm 10. Hereinafter, the portion of the low pressure side diaphragm 10 in the opening portion 12*a* of the plate 12 is referred to as a low pressure side operating portion 10*a*. The low pressure side operating portion 10*a* facing the pulsation operating chamber R11 is an example of a first surface area. The low pressure side operating portion 10*a* faces away from the second operating region R20. The low pressure side operating portion 10*a* receives the pulsating pressure.

A low pressure side backup 11 is attached to the low pressure side diaphragm 10. The low pressure side backup 11 is a plate-shaped member fixed to the low pressure side operating portion 10*a*. The low pressure side backup 11 supports the low pressure side diaphragm 10. For example, two low pressure side backups 11 are provided. The low pressure side diaphragm 10 is sandwiched between the two low pressure side backups 11. The diameter of the low pressure side backup 11 is smaller than the inner diameter of the opening portion 12*a* of the plate 12. One of the low pressure side backup 11 faces the pulsation operating chamber R11 and transmits the pulsating pressure to the low pressure side operating portion 10*a*. The low pressure side backup 10 is an example of a first support member.

Figure 3:
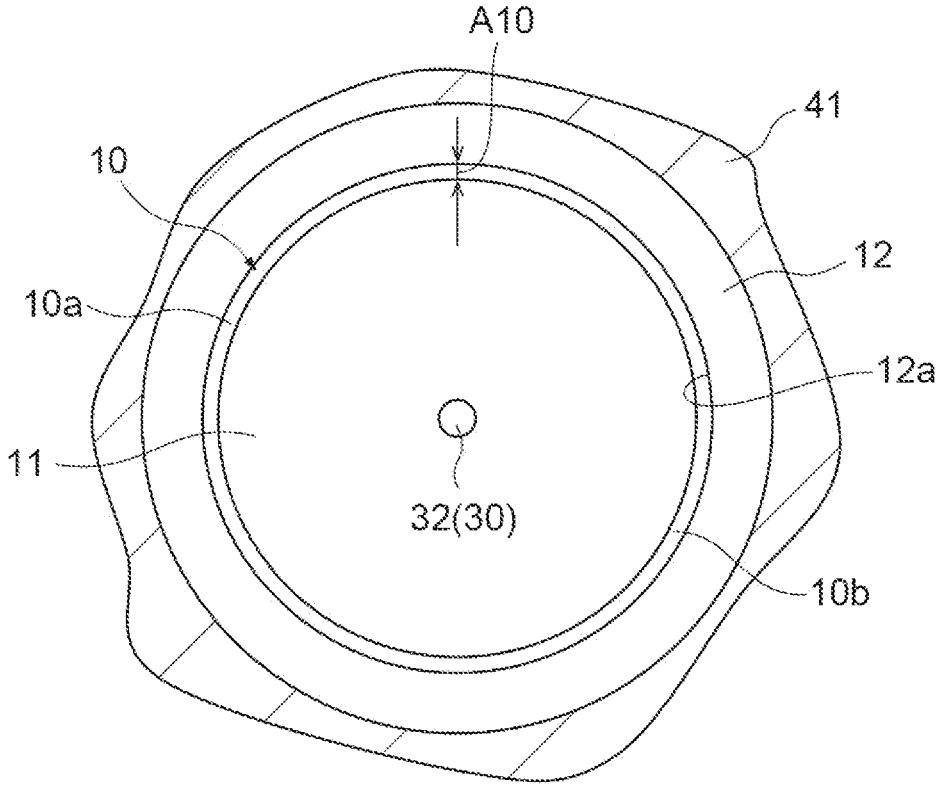
FIG. 3 is a cross-sectional view of the surroundings of a low pressure side diaphragm as seen from a pulsation operating chamber side.

In some examples, as shown in FIG. 3, an annular gap is provided between the outer peripheral edge of the low pressure side backup 11 and the circular opening portion 12*a* of the plate 12 in a radial direction of the circular low pressure side backup 11. The corner of the outer peripheral edge of the low pressure side backup 11 is rounded not to damage the low pressure side diaphragm 10 when the low pressure side diaphragm 10 operates (see FIG. 2).

In this way, the low pressure side diaphragm 10 faces the pulsation operating chamber R11. In some examples, the low pressure side diaphragm 10 forms a part of the pulsation operating chamber R11 to which the pulsating pressure of the crank chamber 2*a* of the engine 2 is transmitted. For this reason, the low pressure side diaphragm 10 operates by receiving the pulsating pressure of the crank chamber 2*a*.

As shown in FIG. 2, the high pressure side diaphragm 20 is disposed between the second main body portion 42 and the third main body portion 43. The high pressure side diaphragm 20 is an example of a second diaphragm. The high pressure side diaphragm 20 is located in the second operating region R20. For example, the high pressure side diaphragm 20 partitions the second operating region R20 into two. One of the spaces defined by the high pressure side diaphragm 20 is a pump chamber R21 and the other is a second back chamber R22. The pump chamber R21 is the space between the high pressure side diaphragm 20 and the recess 43*a* of the third main body portion 43 in the second operating region R20. The pump chamber R21 receives the fuel and sends the fuel to the engine 2. A volume of the pump chamber R21 is smaller than a volume of the pulsation operating chamber R11.

A portion of the high pressure side diaphragm 20 in the second operating region R20 is an operating range of the high pressure side diaphragm 20. Hereinafter, the portion of the high pressure side diaphragm 20 in the second operating region R20 is referred to as a high pressure side operating portion 20*a*. The high pressure side operating portion 20*a* facing the pump chamber R21 is an example of a second surface area. The high pressure side operating portion 20*a* is in contact with the fuel in the pump chamber R21. The high pressure side operating portion 20*a* faces away from the first operating region R10. The high pressure side operating portion 20*a* is smaller than the low pressure side operating portion 10*a*.

A high pressure side backup 21 is attached to the high pressure side diaphragm 20. The high pressure side backup 21 is a plate-shaped member fixed to the high pressure side operating portion 20*a*. The high pressure side backup 21 supports the high pressure side diaphragm 21. The high pressure side backup 20 is an example of a second support member. For example, two high pressure side backups 21 are provided. The high pressure side diaphragm 20 is sandwiched between the two high pressure side backups 21. The diameter of the high pressure side backup 21 is smaller than the diameter of the opening edge of each of the recess 42*b* of the second main body portion 42 and the recess 43*a* of the third main body portion 43. One of the high pressure side backup 21 faces the pump chamber R21 and located between the high pressure side operating portion 20*a* and the fuel in the pump chamber R21.

Figure 4:
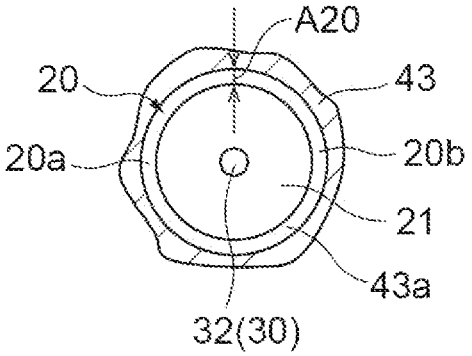
FIG. 4 is a cross-sectional view of the surroundings of a high pressure side diaphragm as seen from a pump chamber side.

In some examples, as shown in FIG. 4, an annular gap is provided between the outer peripheral edge of the high pressure side backup 21 and the opening edge of the recess 43*a* of the third main body portion 43 in a radial direction of the circular high pressure side backup 21. The outer peripheral edge of the high pressure side backup 21 is curved away from the high pressure side diaphragm 20 not to damage the high pressure side diaphragm 20 when the high pressure side diaphragm 20 operates (see FIG. 2). A first contact surface area that fixes the low pressure side backup 11 to the low pressure side diaphragm 10 is larger than a second contact surface area that fixes the high pressure side backup 21 to the high pressure side diaphragm 20.

In this way, the high pressure side diaphragm 20 faces the pump chamber R21. The pump chamber R21 produces pressurized fuel for supply to the fuel injection device 2*b* of the engine 2, as will be described later. In some examples, the high pressure side diaphragm 20 forms a part of the pump chamber R21 from which the fuel is supplied to the fuel injection device 2*b* of the engine 2. The high pressure side diaphragm 20 operates in conjunction with the low pressure side diaphragm 10 to suck the fuel from the fuel tank 3 and to send the fuel to the fuel injection device 2*b* of the engine 2.

As shown in FIG. 2, an intake channel L12 that connects the intake port S2 and the pump chamber R21 to each other is formed in the main body portion 40. The intake channel L12 is fluidly coupled with the pump chamber R21. In some examples, the intake channel L12 guides the fuel guided from the fuel tank 3 to the intake port S2 via the pipe L2 to the pump chamber R21. For example, the intake channel L12 is formed by grooves and holes provided in the second main body portion 42, the third main body portion 43, and the fourth main body portion 44.

Further, a discharge channel L13 that connects the pump chamber R21 and the discharge port S3 to each other is formed in the main body portion 40. The discharge channel L13 is fluidly coupled with the pump chamber R21. In some examples, the discharge channel L13 guides the fuel pressurized in the pump chamber R21 to the discharge port S3. For example, the discharge channel L13 is formed by grooves and holes provided in the second main body portion 42, the third main body portion 43, and the fourth main body portion 44.

The second main body portion 42 is located between the first operating region R10 and the second operating region R20. The second main body portion 42 is located between the low pressure side diaphragm 10 and the high pressure side diaphragm 20. The second main body portion 42 is an example of wall portion. A guide hole 42*c* penetrates the second main body portion 42.

The connecting portion 30 is passed through a guide hole 42*c*. The connecting portion 30 is movable in a penetrating direction of the guide hole 42*c*. The connecting portion 30 connects the low pressure side diaphragm 10 and the high pressure side diaphragm 20 to each other. The connecting portion 30 operates the high pressure side diaphragm 20 to send the fuel to the engine 2 in response to the low pressure side diaphragm 10 receiving the pulsating pressure.

The connecting portion 30 has a first end portion 30*a* and a second end portion 30*b*. The first end portion 30*a* is attached to the low pressure side diaphragm 10. The second end portion 30*b* is attached to the high pressure side diaphragm 20. For example, the first end portion is fixed to a center of the low pressure side diaphragm 10, and the second end portion 30*b* is fixed to a center of the high pressure side diaphragm 20.

The connecting portion 30 includes a sleeve 31 and a rivet 32. The sleeve 31 is passed through the guide hole 42*c*. The rivet 32 is passed through an inside of the sleeve 31 and fix the sleeve 31 to the low pressure side diaphragm 10 and the high pressure side diaphragm 20. The sleeve 31 is disposed between the low pressure side diaphragm 10 and the high pressure side diaphragm 20. Here, the sleeve 31 is disposed between the low pressure side backup 11 provided on a surface of the low pressure side diaphragm 10 on a side of the second main body portion 42, and a high pressure side backup 21 provided on a surface of the high pressure side diaphragm 20 on a side of the second main body portion 42. The sleeve 31 is fixed to the low pressure side diaphragm via the low pressure side backup 11 and fixed to the high pressure side diaphragm 20 via the high pressure side backup 21.

The rivet 32 fixes the low pressure side diaphragm 10 and the high pressure side diaphragm 20 to the sleeve 31 in a state where the sleeve 31 is sandwiched between the low pressure side diaphragm 10 and the high pressure side diaphragm 20. Here, the rivet 32 collectively fixes the two low pressure side backups 11 and the low pressure side diaphragm 10 and the two high pressure side backups 21 and the high pressure side diaphragm 20 to the sleeve 31. As a result, the high pressure side diaphragm 20 operates in conjunction with the low pressure side diaphragm 10. In some examples, the high pressure side diaphragm operates in conjunction with the low pressure side diaphragm 10 by being connected to the low pressure side diaphragm 10 by the connecting portion 30, wherein the low pressure side diaphragm operates with the pulsating pressure in the crank chamber 2*a* of the engine 2.

The guide hole 42*c* provided in the second main body portion 42 has a cylindrical shape extending in a direction in which the low pressure side diaphragm 10 and the high pressure side diaphragm 20 are arranged. The outer peripheral surface of the sleeve 31 of the connecting portion 30 is in slidable contact with the inner peripheral surface of the guide hole 42*c* of the second main body portion 42. In some examples, the movement direction of the sleeve 31 of the connecting portion 30 is guided by the guide hole 42*c* of the second main body portion 42. As a result, the operating directions of the low pressure side diaphragm 10 and the high pressure side diaphragm 20 are defined.

Here, in the high pressure side diaphragm 20, a portion of the high pressure side operating portion 20*a* described above operates in conjunction with the low pressure side diaphragm 10. In the low pressure side diaphragm 10, a portion of the low pressure side operating portion 10*a* described above operates by receiving the pulsating pressure in the crank chamber 2*a* of the engine 2. For example, an area of the high pressure side operating portion 20*a* of the high pressure side diaphragm 20 is smaller than an area of the low pressure side operating portion 10*a* of the low pressure side diaphragm 10.

Further, an area of the low pressure side backup 11 is larger than an area of the high pressure side backup 21. Here, the area of the low pressure side backup 11 is an area of the low pressure side backup 11 located in the pulsation operating chamber R11 of the two low pressure side backups 11. Further, the area of the low pressure side backup 11 here is an area of a surface facing the inside of the pulsation operating chamber R11 (a surface facing a side of the recess 41*a* of the first main body portion 41) of the outer surface of the low pressure side backup 11 located in the pulsation operating chamber R11. Similarly, the area of the high pressure side backup 21 is an area of the high pressure side backup 21 located in the pump chamber R21 of the two high pressure side backups 21. Further, the area of the high pressure side backup 21 here is an area of a surface facing the inside of the pump chamber R21 (a surface facing a side of the recess 43*a* of the third main body portion 43) of the outer surface of the pump chamber R21 located in the high pressure side backup 21.

As described above, the low pressure side diaphragm 10 is sandwiched between the two low pressure side backups 11. For this reason, a movable portion of the low pressure side diaphragm 10 is a portion between the outer peripheral edge of the low pressure side backup 11 and the inner peripheral edge of the plate 12. In some examples, the low pressure side diaphragm 10 has an annular low pressure side movable portion 10*b* around the low pressure side backup 11 (see FIG. 3). The annular low pressure side movable portion 10*b* is an example of a movable portion or a first annular movable portion.

Similarly, the high pressure side diaphragm 20 is sandwiched between the two high pressure side backups 21. For this reason, a movable portion of the high pressure side diaphragm 20 is a portion between the outer peripheral edge of the high pressure side backup 21 and the opening edge of the recess 42*a* of second main body portion 42 or the like. In some examples, the high pressure side diaphragm 20 has an annular high pressure side movable portion 20*b* around the high pressure side backup 21. The annular high pressure side movable portion 20*b* is an example of a movable portion or a second annular movable portion.

In some examples, the annular low pressure side movable portion 10*b* has a width 10A in a radial direction with respect to the low pressure side diaphragm 10 (FIG. 3). The annular high pressure side movable portion 20*b* has a width 20A in a radial direction with respect to the low pressure side diaphragm 20 (FIG. 4). The width 10A is smaller than the width 20A.

The intake valve 50 is provided in the intake channel L12. The discharge valve 60 is provided in the discharge channel L13. The intake valve 50 and the discharge valve 60 are opened and closed such that when the high pressure side diaphragm 20 operates, the fuel is sent from the intake channel L12 to the pump chamber R21 and the fuel is discharged from the pump chamber R21 via the discharge channel L13. In some examples, the intake valve 50 and the discharge valve 60 are opened and closed such that a pump mechanism is realized through the operation of the high pressure side diaphragm 20.

For example, the intake valve 50 includes a valve body 51 and a spring 52. The valve body 51 may be configured to selectively open or closes the intake channel L12. Here, the valve body 51 may be configured to selectively open or close an opening portion of a flow channel portion provided in the third main body portion 43 of the members forming the intake channel L12. The spring 52 biases the valve body 51 such that the intake channel L12 is closed. The intake valve 50 allows circulation of the fuel only in a direction from the intake port S2 to the pump chamber R21 in the intake channel L12 and cuts off circulation of the fuel in a direction opposite to the above-described direction by opening and closing the valve body 51.

The discharge valve 60 has a valve body 61 and a spring 62. The valve body 61 may be configured to selectively open or close the discharge channel L13. Here, the valve body 61 may be configured to selectively open or close an opening portion of a flow channel portion provided in the third main body portion 43 of the members forming the discharge channel L13. The spring 62 biases the valve body 61 such that the discharge channel L13 is closed. The discharge valve 60 allows circulation of the fuel only in a direction from the pump chamber R21 to the discharge port S3 in the discharge channel L13 and cuts off circulation of the fuel in a direction opposite to the above-described direction by opening and closing the valve body 61.

As described above, in this diaphragm pump 1, the low pressure side diaphragm 10 that operates by receiving the pulsating pressure in the crank chamber 2*a* and the high pressure side diaphragm 20 that sends the fuel are separately provided. The high pressure side diaphragm 20 operates in conjunction with the low pressure side diaphragm 10, and the area of the high pressure side operating portion 20*a* is smaller than the area of the low pressure side operating portion 10*a*. In some examples, due to the difference in area between the low pressure side operating portion 10*a* and the high pressure side operating portion 20*a*, the high pressure side diaphragm 20 can apply a pressure higher than the pulsating pressure in the crank chamber 2*a* to the fuel. In this way, the diaphragm pump 1 can further pressurize the fuel by receiving the pulsating pressure in the crank chamber 2*a* of the engine 2 and supply the further pressurized fuel.

In the diaphragm pump 1, the area of the low pressure side backup 11 attached to the low pressure side diaphragm 10 is larger than the area of the high pressure side backup 21 attached to the high pressure side diaphragm 20. The diaphragm pump 1 may curb unintended deflection of the low pressure side diaphragm 10 and the high pressure side diaphragm 20 with the low pressure side backup 11 and the high pressure side backup 21 and to operate the low pressure side diaphragm 10 and the high pressure side diaphragm 20.

The low pressure side diaphragm 10 has the annular low pressure side movable portion 10*b* around the low pressure side backup 11. The high pressure side diaphragm 20 has the annular high pressure side movable portion 20*b* around the high pressure side backup 21. Further, the width A10 of the annular low pressure side movable portion 10*b* in the radial direction is smaller than the width A20 of the annular high pressure side movable portion 20*b* in the radial direction.

Here, in a case where the width of the low pressure side movable portion 10*b* is increased, it is conceivable that only this low pressure side movable portion 10*b* will move by receiving the pulsating pressure in the crank chamber 2*a*. Therefore, by reducing the width of the low pressure side movable portion 10*b* may curb only the low pressure side movable portion 10*b* being movable. As a result, the entire low pressure side diaphragm 10 moves, and the high pressure side diaphragm 20 can be operated in conjunction with the low pressure side diaphragm 10.

Further, since the width of the high pressure side movable portion is larger than the width of the low pressure side movable portion 10*b*, a stroke (a movement amount) of the high pressure side diaphragm 20 can be ensured to be larger. As a result, when the high pressure side diaphragm 20 operates in conjunction with the low pressure side diaphragm 10, the high pressure side diaphragm 20 can be operated without being restricted in the amount of movement caused by the width of the high pressure side movable portion 20*b*.

It is to be understood that not all aspects, advantages and features described herein may necessarily be achieved by, or included in, any one particular example. Indeed, having described and illustrated various examples herein, it should be apparent that other examples may be modified in arrangement and detail. For example, the shapes of the pulsation transmitting channel L11, the intake channel L12, and the discharge channel L13 provided in the main body portion 40, the configurations of the intake valve 50 and the discharge valve 60, and the like are not limited to those shown in FIG. 2. In addition, the configuration of the connecting portion 30 is not limited to the configuration described above as long as the low pressure side diaphragm and the high pressure side diaphragm 20 can be connected to each other.

What is claimed is:

1. A diaphragm pump that operates by receiving a pulsating pressure in a crank chamber of an engine, the diaphragm pump comprising:

a low pressure side diaphragm forming a part of a pulsation operating chamber and configured to receive the pulsating pressure, wherein the low pressure side diaphragm includes a low pressure side operating portion that is configured to operate in response to receiving the pulsating pressure, and an annular low pressure side movable portion;

a low pressure side backup attached to and configured to support the low pressure side operating portion, wherein the annular low pressure side movable portion is located around the low pressure side backup;

a high pressure side diaphragm forming a part of a pump chamber and configured to send fuel to the engine, wherein the high pressure side diaphragm includes a high pressure side operation portion and an annular high pressure side movable portion;

a high pressure side backup attached to and configured to support the high pressure side operating portion, wherein the annular high pressure side movable portion is located around the high pressure side backup; and a connecting portion connecting the low pressure side diaphragm and the high pressure side diaphragm to each other, wherein the high pressure side diaphragm operates in conjunction with the low pressure side diaphragm by being connected to the low pressure side diaphragm by the connecting portion, wherein an area of the high pressure side operating portion is smaller than an area of the low pressure side operating portion, and wherein a width of the annular low pressure side movable portion in a radial direction of the annular low pressure side movable portion is smaller than a width of the annular high pressure side movable portion in a radial direction of the annular high pressure side movable portion.

2. The diaphragm pump according to claim 1,
wherein an area of the low pressure side backup is larger than an area of the high pressure side backup.

3. A diaphragm pump comprising:
a first operating chamber;
a second operating chamber;
a first diaphragm located in the first operating chamber and including a first surface area that is configured to receive a pulsating pressure, and a first annular movable portion;
a first support member fixed to the first surface area and configured to transmit the pulsating pressure to the first surface area, wherein the first annular movable portion of the first diaphragm is located around the first support member;
a second diaphragm located in the second operating chamber and including a second surface area in contact with fuel for an engine, and a second annular movable portion;
a second support member fixed to the second surface area and located between the second surface area and the fuel, wherein the second annular movable portion of the second diaphragm is located around the second support member; and
a connecting portion connecting the first diaphragm and the second diaphragm, and configured to operate the second diaphragm to send the fuel to the engine in response to the first diaphragm receiving the pulsating pressure,
wherein the second surface area is smaller than the first surface area, and
wherein a width of the first annular movable portion in a radial direction of the first annular movable portion is smaller than a width of the second annular movable portion in a radial direction of the second annular movable portion.

4. The diaphragm pump according to claim 3, wherein a volume of the second operating chamber is smaller than a volume of the first operating chamber.

5. The diaphragm pump according to claim 3,
wherein the first diaphragm partitions the first operating chamber into a pulsation operating chamber that receives the pulsating pressure and a first back chamber,
wherein the second diaphragm partitions the second operating chamber into a pump chamber that sends the fuel to the engine and a second back chamber.

6. The diaphragm pump according to claim 5, further comprising a main body portion including the first operating chamber and the second operating chamber,
wherein the main body portion comprises:
a pulsation transmitting channel that is connected to the pulsation operating chamber and transmits the pulsating pressure to the first diaphragm;
an intake channel fluidly coupled with the pump chamber; and
a discharge channel fluidly coupled with the pump chamber.

7. The diaphragm pump according to claim 5, wherein a volume of the pump chamber is smaller than a volume of the pulsation operating chamber.

8. The diaphragm pump according to claim 3, wherein a first contact surface area that fixes the first support member to the first diaphragm is larger than a second contact surface area that fixes the second support member to the second diaphragm.

9. The diaphragm pump according to claim 3, further comprising:
a wall portion located between the first operating chamber and the second operating chamber; and
a guide hole penetrating the wall portion,
wherein the connecting portion passes through the guide hole and is movable in a penetrating direction of the guide hole, and
wherein the wall portion contacts the connecting portion and the guide hole guides a movable direction of the connecting portion.

10. The diaphragm pump according to claim 9,
wherein the connecting portion comprises a first end portion fixed to the first diaphragm, and a second end portion fixed to the second diaphragm,
wherein the first end portion is fixed to a center of the first diaphragm in the first operating chamber, and
wherein the second end portion is fixed to a center of the second diaphragm in the second operating chamber.

11. The diaphragm pump according to claim 9, wherein the connecting portion comprises:
a sleeve that passes through the guide hole; and
a rivet that passes through an inside of the sleeve and is configured to fix the sleeve to the first diaphragm and the second diaphragm.

12. The diaphragm pump according to claim 11, further comprising:
a first support member fixed to the first diaphragm in the first operating chamber; and
a second support member fixed to the second diaphragm in the second operating chamber,
wherein the sleeve is fixed to the first diaphragm via the first support member and is fixed to the second diaphragm via the second support member.

13. A diaphragm pump comprising:
a first operating chamber;
a second operating chamber located adjacent to the first operating chamber;
a first diaphragm located in the first operating chamber;
a second diaphragm located in the second operating chamber;
a connecting portion connecting the first diaphragm and the second diaphragm, and configured to operate the second diaphragm in response to the first diaphragm receiving a pulsating pressure; and
a wall portion located between the first operating chamber and the second operating chamber in a movement direction of the connecting portion,
wherein the wall portion comprises a guide hole which contacts and guides the connecting portion through the wall portion in the movement direction of the connecting portion,
wherein the first diaphragm includes a first surface area facing away from the second operating chamber,
wherein the second diaphragm includes a second surface area facing away from the first operating chamber, and
wherein the second surface area is smaller than the first surface area.

14. The diaphragm pump according to claim 13, wherein a volume of the second operating chamber is smaller than a volume of the first operating chamber.

15. The diaphragm pump according to claim 13,
wherein the first diaphragm is configured to operate by receiving the pulsating pressure of gas, and
wherein the second diaphragm is configured to operate so as to send liquid in response to the pulsating pressure of gas received by the first diaphragm.

16. The diaphragm pump according to claim 13, further comprising:

a first chamber located between the first diaphragm and the wall portion; and a second chamber located between the second operating chamber and the wall portion, wherein the wall portion separates and prohibits fluid communication between the first chamber and the second chamber.

17. The diaphragm pump according to claim 13, wherein the connecting portion comprises a first end portion fixed to the first diaphragm, and a second end portion fixed to the second diaphragm, wherein the first end portion is fixed to a center of the first diaphragm in the first operating chamber, and wherein the second end portion is fixed to a center of the second diaphragm in the second operating chamber.

18. The diaphragm pump according to claim 13, further comprising:

a first support member fixed to the first diaphragm; and a second support member fixed to the second diaphragm, wherein an area of the first support member is larger than an area of the second support member.

19. The diaphragm pump according to claim 13, further comprising:

a first support member fixed to the first diaphragm; and a second support member fixed to the second diaphragm, wherein the first diaphragm comprises a first annular movable portion around the first support member, and wherein the second diaphragm comprises a second annular movable portion around the second support member.

20. The diaphragm pump according to claim 19 wherein a width of the first annular movable portion in a radial direction of the first annular movable portion is smaller than a width of the second annular movable portion in a radial direction of the second annular movable portion.

* * * * *